United States Patent [19]

Babich et al.

[11] 4,205,786

[45] Jun. 3, 1980

[54] ATOMIZING DEVICE

[76] Inventors: Gennady V. Babich, ulitsa 6 Stantsionnaya, 5, kv. 38; Vladimir F. Antonenko, Kamerny pereulok, 46, kv. 61; Mikhail Y. Bobrik, ulitsa Chekhova, 3, kv. 102; Vasily V. Novikov, ulitsa 22 Aprelya, 14a, kv. 36; Georgy A. Belyaev, Sportivny proezd, 6, kv. 15; Nikolai K. Korenyak, Kamerny pereulok, 52, kv. 39, all of Omsk, U.S.S.R.

[21] Appl. No.: 857,522

[22] Filed: Dec. 5, 1977

[51] Int. Cl.[2] ..... B05B 7/10; B05B 17/06

[52] U.S. Cl. ..... 239/102; 239/404; 239/425; 239/488

[58] Field of Search ..... 239/102, 488, 424.5, 239/425, 405, 404

[56] References Cited

U.S. PATENT DOCUMENTS

| | | | |
|---|---|---|---|
| 3,667,679 | 6/1972 | Wiesenberger | 239/102 |
| 3,731,877 | 5/1973 | Nekrasov | 239/102 |

FOREIGN PATENT DOCUMENTS

| | | | |
|---|---|---|---|
| 1210699 | 10/1970 | United Kingdom | 239/102 |
| 539206 | 12/1976 | U.S.S.R. | 239/102 |
| 558715 | 5/1977 | U.S.S.R. | 239/102 |

*Primary Examiner*—Andres Kashnikow

*Attorney, Agent, or Firm*—Lackenbach, Lilling & Siegel

[57] ABSTRACT

The atomizing device of the present invention comprises a cylindrical swirl chamber provided with a nozzle, and a pipe running coaxially through the chamber and the nozzle to protrude into the zone of material atomization. The device is provided, according to the invention, with another chamber which is essentially an acoustic resonator, the outlet end of said pipe entering the interior of the second chamber which adjoins the nozzle. The second chamber is implemented as a quarter-wave acoustic resonator. The present invention can find most utility when applied in those industries where quality atomization and/or mixture-formation of various materials is involved, such as in the chemical engineering industry.

9 Claims, 3 Drawing Figures

ATOMIZING DEVICE

FIELD OF THE INVENTION

This invention relates to heat-power engineering and has particular reference to atomizing device; the invention can find application in those industries where quality atomization and/or mixture-formation of various materials is involved, which may be the case in firing systems, diverse chemical-engineering apparatus, and the like.

DESCRIPTION OF THE PRIOR ART

One prior-art atomizing device (cf., e.g., British Patent No. 1,210,699 Cl.B2F) is known to comprise a cylindrical swirl chamber with a cylindrical nozzle held coaxially thereto, the length of said nozzle being much greater than its diameter. A small chamfer-like widening of the nozzle is provided at the nozzle exit. A pipe feeding the material to be atomized runs through the swirl chamber and the nozzle, respectively, the outlet pipe end having a number of through holes which may be situated only within said chamfer, while the outside end face of the pipe outlet end is made flush with the nozzle exit end.

An atomizing gas is fed into the cylindrical swirl chamber tangentially to the surface thereof, with the result that said gas is imparted rotary motion. While passing length wise of the axis of the device, the atomizing gas enters into the nozzle and from there flows into the adjacent space of a corresponding apparatus. When the atomizing gas passes from the swirl chamber into the nozzle, the degree of swirling is much increased due to the nozzle diameter being much less than the swirl chamber diameter, to such an extent that acoustic oscillations are generated in the nozzle. Upon feeding the material being atomized inside the chamfer of the nozzle end, said oscillations promote its finer atomization and, after the mixture has left the nozzle, formation of a higher-quality mixture.

However, only in a specific particular embodiment of the device and at given particular rates of flow of the atomizing gas, when the constructional size of the device is selected within an optimum ratio, is the emitted maximum power of acoustic oscillations attained. Furthermore, provision of the pipe outlet end flush with the nozzle exit end adversely affects aerodynamic conditions of the gas flow through the nozzle annular gap which results in further losses of energy imparted to the material being atomized, and reduces the amount of the energy of acoustic oscillations generated in the nozzle.

SUMMARY OF THE INVENTION

It is therefore a general object of the present invention to obviate the disadvantages mentioned above.

It is a specific object of the present invention to provide such a construction of an atomizing device that would enable one to considerably increase the power of the generated acoustic oscillations of the flow of atomizing gas.

These objects are accomplished by our atomizing device, comprising a cylindrical swirl chamber, wherein rotation of the flow of an atomizing gas occurs. The swirl chamber has a nozzle to provide a higher degree of swirling which results in generation of acoustic oscillations, and a pipe coaxially running through the chamber and the nozzle into the zone of atomizing of the material fed therethrough. According the invention another chamber, which is in fact a resonator of acoustic oscillations corresponding to those of a swirled flow of the atomizing gas, has an inlet hole adjoining the nozzle end, the outlet pipe and protruding substantially outwards of the nozzle to enter through the inlet hole inside said second chamber, wherein atomization of the feed material occurs.

Such an embodiment of the construction of the present atomizing device enables one to considerably increase the power of the generated acoustic oscillations of the flow of atomizing gas.

The second chamber is preferably made as a quarter-wave acoustic resonator.

The above feature provides for optimum conditions for amplifying the acoustic oscillations of the respective harmonics.

The second chamber must be made as a cylinder whose diameter is a few times that of the nozzle.

This enables one to bring hydrodynamic and acoustic characteristics of the second chamber in accord with those of the nozzle, wherein acoustic oscillations are generated.

The length of the second chamber must be equal to or in excess of the diameter thereof.

This makes it possible to attain a simultaneous maximum concentration of acoustic energy in one direction and maximum amplification thereof.

In addition, the outlet pipe end must have a number of through holes and/or be provided with a spray spout.

This induces to a higher-quality atomization of the material discharged from the pipe and formation of a better mixture.

BRIEF DESCRIPTION OF THE DRAWINGS

In what follows the present invention is illustrated in some specific embodiments thereof given with reference to the accompanying drawings, wherein.

DETAILED DESCRIPTION OF THE INVENTION

Figure 1:
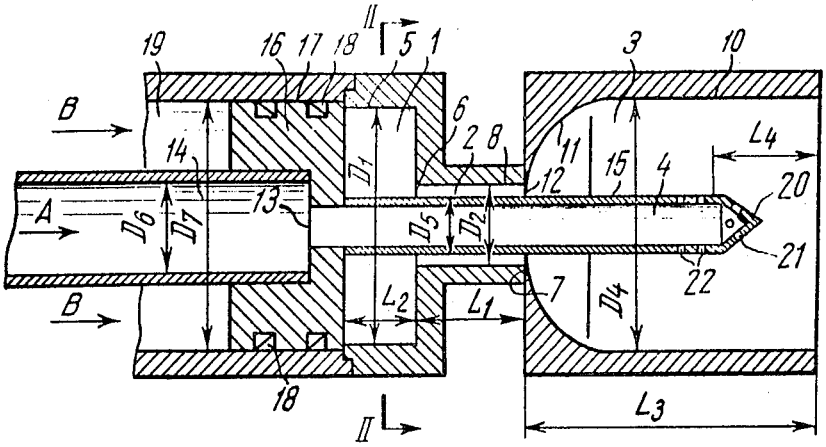
FIG. 1 is a longitudinal section view of an atomizing device, according to the invention.

Reference is now directed to the accompanying drawings, the atomizing device disclosed herein comprises a cylindrical swirl chamber 1 (FIG. 1) adapted to rotate the flow of an atomizing gas, then chamber having a nozzle 2 adapted to enhance the degree of swirling of said gas thus resulting in the generation of acoustic oscillations. Another chamber 3 adjoins the nozzle 2, for amplification of the oscillations generated in the nozzle 2. A pipe 4 is arranged concentrically with the swirl chamber 1, the nozzle 2 and the second chamber 3, this pipe being adapted for the material being atomized to be red to the point of its admission to the second chamber 3.

An inside surface 5 of the swirl chamber 1 is cylindrical-shaped so as to provide optimum conditions for rotating the flow of the atomizing gas. The shape of the surface 5 of the swirl chamber 1 may be arbitrarily selected to suit additional requirements imposed upon the device. The swirl chamber 1 communicates with the nozzle 2 through an opening 6. The places of transition from the swirl chamber 1 to the nozzle 2 are preferably rounded to reduce hydrodynamic losses. The transition from the inside cylindrical surface 5 of the swirl chamber 1 to the nozzle 2 may be made curvilinear with a view to reducing hydrodynamic losses and improving the hydrodynamic flow conditions of the swirled flow of the atomizing gas. The nozzle 2 has an end 7.

Figure 2:
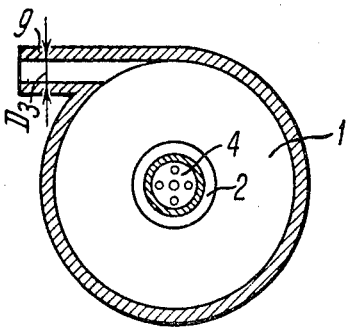
FIG. 2 is a cross-sectional view taken along the line II—II of FIG. 1 of the swirl chamber in a specific embodiment of the present invention featuring a tangential feed of the atomizing gas, according to the invention.

An inside surface 8 of the nozzle 2 is cylindrical-shaped and is coaxial with the swirl chamber 1. The length $L_1$ of the nozzle 2 must be equal to about 0.7 to 5.0 of height $L_2$ of times the the swirl chamber 1. With said dimensional requirements satisfied an optimum acoustical coupling between the interior spaces of the swirl chamber 1 and the nozzle 2 is achieved. In addition, with the abovesaid length $L_1$ of the nozzle 2 a stable swirled flow of the atomizing gas is established which promotes the generation of stable acoustic oscillations. The diameter $D_2$ of the nozzle 2 is selected to be in a strict relationship with the diameter $D_1$ of the swirl chamber 1 and the diameter $D_3$ of an inlet tangential sleeve 9 whenever tangential (with respect to the inside cylindrical surface 5) admission of the atomizing gas is effected through the tangential sleeve 9 (FIG. 2). This relationship is termed the geometrical characteristic of an atomizing device and proves to be a dimensionless quantity expressed in the mathematical function $A=(R.^4n)/r_{is}^2$, where A is the geometrical characteristic of the atomizing device;

R is the radius of the swirl chamber 1 ($R=D_1/2$);

$r_n$ is the radius of the nozzle 2 ($r_n=D_2)/2$; and $r_{is}$ is the cross-sectional radius of the inlet sleeve 9 ($r_{is}=D_3/2$).

The numerical value of the geometrical characteristic A is selected so as to obtain optimum operating conditions thereof. It is established experimentally that, when generating acoustic oscillations at a frequency of, for example, 3.0 to 6.0 kHz, the geometrical characteristic A of the atomizing device should be within about 27 to 32 to obtain a maximum power of said oscillations.

An inside surface 10 of the second chamber 3 is shaped as a cylinder to obtain its optimum hydrodynamic characteristics. A surface 11 of the second chamber 3 (as shown in FIG. 1) is shaped as a parabola, though it may be shaped as a plane or cone. The second chamber 3 has an inlet hole 12.

The second chamber 3 is adapted for amplifying the acoustic oscillations generated in the nozzle 2, according to the resonation principle. That is why the second chamber 3 is in effect a resonator, and its connection, through the inlet hole 12, to the end 7 of the nozzle 2 results in an abrupt amplification of the acoustic oscillations (by about 25 to 30 percent). This is because of the presence of a resonance of the natural oscillation frequency of the cavity of the second chamber 3 and the frequency of one of the harmonics of acoustic oscillations emitted in the nozzle 2. In this respect the dimensions of the second chamber 3 are to be selected so as to gain a specific acoustic oscillation harmonic emitted by the nozzle 2. Thus, the second chamber 3 is essentially a third acoustic cavity after the swirl chamber 1 and the nozzle 2. At a definite rate of flow of the atomizing gas and an invariable spatial dimensions of the device, the base frequency of the emitted acoustic oscillations proves to be definite. Accordingly, the dimensions of the second chamber 3 are strictly definite. The length $L_3$ of the second chamber 3 of the acoustic resonator is calculated by the known formula $f=a/4L_3$, where f is the resonant frequency of acoustic oscillations;

a is the sound velocity in the swirled outflow of the atomizing gas; and $L_3$ is the length of the second chamber 3 which is a resonant cavity of acoustic oscillations.

The diameter $D_4$ of the second chamber 3 is to be selected to suit the desired angle of flare of the spray at the exit of the nozzle 2 and the axial velocity of the swirled flow of gas, i.e., the flow rate thereof. At small angles of flare the diameter $D_4$ of the second chamber 3 is small, and vice versa.

Maximum amplification of acoustic oscillations by the second chamber 3 occurs when the ratio between the diameter $D_4$ thereof and the diameter $D_2$ of the nozzle 2 equals approximately 1.2 to 4.5.

Inasmuch as the second chamber 3 is an acoustic resonator it must meet all requirements imposed upon resonant acoustic cavities. Thus, e.g., its length $L_3$ may be divisible by one-fourth of the wavelength of the acoustic oscillations of the swirled flow of the atomizing gas, i.e., the second chamber 3 may serve as a quarter-wave resonator. In addition, it must satisfy the following prerequisite: its length $L_3$ must be equal to or in excess of the diameter $D_4$ thereof. The admission end of the pipe 4 communicates with a pipe 14 feeding the material to be atomized thereto through a hole 13. The surface 15 of the pipe 4 is cylindrical throughout its entire length. The pipes 4 and 14 are interconnected through a bushing 16 thus setting up a concentric arrangement of the pipe 4 inside the swirl chamber 1, the nozzle 2 and the second chamber 3. Apart from that, an outside surface 17 of the bushing 16 is provided with helical grooves 18 for the atomizing gas to fed from a pipe 19 into the swirl chamber 1, and at the same time rotating the flow of gas for effecting a tangentional admission of said atomizing gas into the swirl chamber 1.

Figure 3:
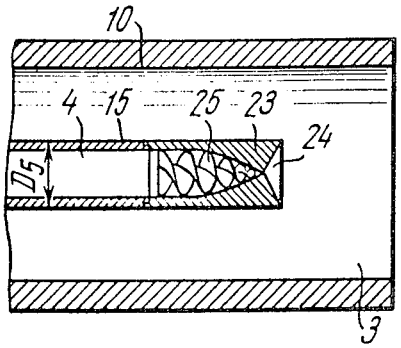
FIG. 3 is a an enlarged sectional view of a part of the second chamber along with the outlet end of the pipe coaxially running through the swirl chamber and the nozzle, in the case where the outlet pipe end is provided with a spray spout, according to the invention.

The outlet portion of the pipe 4 is closed at the exit end thereof by a blank plug 20 which is taper-shaped in the given particular embodiment of the device. The blank plug 20 has a number of holes 21 for discharging the material being atomized. The cylindrical surface 15 of the outlet portion of the pipe 4 also has a number of through holes 22 for discharging the atomized material. The discharge holes 22 may be arranged in several rows. Apart from the discharge holes 21 and 22 the outlet portion of the pipe 4 may be provided with a spray spout 23, as illustrated in FIG. 3, with an outlet cone 24 featuring a flare angle of about 20° to 160° and a helical insert 25 for the atomized material to rotate. Variation of the distance $L_4$ from the axis of the holes 22 to the exit section of the second chamber 3 changes the quality of atomization and the operational reliability of the device and mixture-formation. The best operating conditions of the device as a whole is attained when the outside diameter $D_5$ of the pipe 4 is 0.30 to 0.85 times the inside diameter $D_2$ of the nozzle 2.

The material to be atomized is fed in the direction indicated by the arrow A into the pipe 14, said pipe 14 having a diameter $D_6$ large enough to reduce hydrodynamic resistance. From the pipe 14 the material passes into the pipe 4 through the hole 13 and flows along said pipe to the discharge holes 21 and 22 through which it is fed into the second chamber 3 in a number of fine streams. When the material being atomized flows out from the discharge holes 21 and 22, it becomes preatomized in the flow of atomizing gas due to said flow expanding while passing through the second chamber 3. The atomizing gas is fed in the direction indicated by the arrows B to the pipe 19 having a diameter $D_7$ large enough to reduce hydrodynamic losses therein. From the pipe 19 the atomizing gas flows into the helical grooves 18, wherein it is rotated and is then admitted tangentially to the swirl chamber 1. It is in the swirl chamber 1 that the flow conditions of the atomizing gas becomes stabilized. From the swirl chamber 1 the rotated flow of the atomizing gas is directed to the nozzle 2, where its rotational velocity is greatly increased so that acoustic oscillations are generated in the nozzle 2. These oscillations are generated because of the interaction of the swirled flow of the atomizing gas flowing out from the nozzle 2 and the back flow of the surrounding atmosphere in the nozzle 2, i.e., to a very high rarefaction established at the exit of the nozzle 2. It shall be noted that a rarefaction, though of much less extent, is provided in the swirl chamber 1 as well. Then the acoustically excited flow of the atomizing gas is fed from the nozzle 2 to the second chamber 3, wherein the natural oscillation frequency equals that of the acoustic oscillations of the swirled flow of the atomizing gas. It is in said chamber that the flow of the atomizing gas is turned to be forced against the inside surface thereof, thus flowing around said surface while moving about the axis of the second chamber 3 and lengthwise of said axis. Thus, the provision of the abovementioned gasdynamic phenomena makes it possible to amplify the acoustic oscillations of the rotating flow of the atomizing gas due to the presence of the following effects. First, amplification of acoustic oscillations occurs in the second chamber 3 due to a resonance between the frequency of acoustic oscillations of the swirled flow of the atomizing gas and the frequency of the natural oscillations of the second chamber 3. Secondly, the conditions of reflection and interference of acoustic waves provided in the second chamber 3 enable said waves to be amplified and, moreover, concentrated in a single direction. Furthermore, amplification of acoustic oscillations is effected by the interaction of the swirled flow of the atomizing gas flowing out from the second chamber 3 with the flow of the atmosphere surrounding the atomizing device and making its way into the second chamber 3.

The flow of the atomizing gas swirled inside the second chamber 3 with the amplified acoustic oscillations therein acts upon the streams of the material being atomized flowing out from the discharge holes 21 and 22 of the outlet portion of the pipe 4 to atomize said streams. The atomizing effect is also intensified due to the fact that the rotating acoustically excited flow of the atomizing gas acts upon the streams of the material being handled just at the instance said streams are no longer a solid medium but are in fact a stream of separate particles, i.e., further disintegration thereof takes place. This is induced by the spatial dimensions of the second chamber 3 which enable the provision of a sufficiently long distance for the streams of the material to preatomize when said streams pass from the holes 22 to the surface 10 of the second chamber 3. Provision of a definite and long enough distance $L_4$ between the streams flowing out from the holes 21 and 22 and the exit section of the second chamber 3 establishes a condition for a quality preliminary mixture formation featuring a high fineness ratio of the particles thereof and their even spread across the spray area. This provides for utilization of the given atomizing device in those process apparatus where quality dispersion and mixture formation is required.

It is a quality dispersing and mixture forming that is necessary, say, in fuel combustion process occurring in burner devices. Therefore, the given atomizing device may be applied in diverse burner devices, preferably in those fired by liquid or gaseous fuels.

In such devices fuel and oxidant are fed into the firing chamber as a preliminary prepared mixture, as preliminary mixing proves to be one of the most efficient ways of intensifying the combustion process.

The herein-proposed atomizing device, according to the invention, is advantageous in that acoustic energy concentrated along the axis thereof makes it possible not only to define a quality mixture formation but also to establish a mixture spray discharged from the device of the required shape.

Moreover, a secondary air stream, flowing around the device from outside, contributes to more efficient combustion due to formation of fuel mixtures required for a complete fuel combustion, and the provision of an additional combustion front.

Apart from that effect, the secondary air stream additionally cools the atomizing device of the present invention, whereby the device is applicable in high-temperature and corrosive conditions of firing systems, such as those of chemical engineering apparatus.

What is claimed is:

1. An atomizing device, comprising:

a cylindrical swirl chamber in which a flow of an atomizing gas is rotated, an inlet of said swirl chamber being connected to a source of said atomizing gas;

a nozzle coaxially arranged with said swirl chamber and in which the degree of swirling of said flow of said atomizing gas is enhanced to generate acoustic oscillations, the length of the nozzle being equal to about 0.7 to 5.0 times the length of the swirl chamber, an inlet of said nozzle being connected to an outlet of said swirl chamber;

a resonance chamber coaxially arranged with said swirl chamber and said nozzle and serving as a resonator of said acoustic oscillations of said swirled flow of said atomizing gas, the ratio of the inside diameter of the resonance chamber to the inside diameter of the nozzle being in the range of about 1.2 to 4.5, the length of the resonance chamber being at least equal to the inside diameter of the resonance chamber, an inlet of said resonance chamber being connected to an outlet of said nozzle; and a pipe arranged coaxially and concentrically with said swirl chamber, said nozzle and said resonance chamber and feeding the material to be atomized into said resonance chamber, an inlet of said pipe being connected to a source of said material to be atomized and an outlet of said pipe extending into said resonance chamber, the outside diameter of the pipe being equal to about 0.3 to 0.85 times the inside diameter of the nozzle, the atomized material being expelled from an outlet of said resonance chamber.

2. An atomizing device as claimed in claim 1, wherein said second chamber is a quarter-wave acoustic resonator.

3. An atomizing device as claimed in claim 1, wherein the outlet of said pipe has a plurality of discharge holes.

4. An atomizing device as claimed in claim 1, wherein the outlet of said pipe is provided with a spray spout.

5. An atomizing device according to claim 1 wherein said inlet of said swirl chamber is tangential to said swirl chamber; and wherein a geometrical characteristic of said atomizing device is within the range of about 27 to 32 and is determined by the formula:

$$A=(R.r_n)/r_{is}^2$$

where R is the radius of the swirl chamber, $r_n$ is the radius of the nozzle, and $r_{is}$ is the radius of the inlet of the swirl chamber.

6. An atomizing device according to claim 1, wherein a bushing is provided in said inlet of said swirl chamber, an outer surface of said bushing being provided with helical grooves.

7. An atomizing device according to claim 6, wherein said bushing connects said pipe to said source of said material being atomized.

8. An atomizing device according to claim 1, wherein the resonant frequency of said acoustic oscillations of said flow of atomizing gas is determined by the formula:

$$f=a/4L_3$$

where a is the sound velocity in a swirled outflow of said atomizing gas, and $L_3$ is the length of said resonance chamber.

9. An atomizing device according to claim 1, wherein said nozzle and said resonance chamber are cylindrical.

* * * * *